US008555826B2

(12) United States Patent
Feldhaus et al.

(10) Patent No.: US 8,555,826 B2
(45) Date of Patent: Oct. 15, 2013

(54) COOLER ARRANGEMENT FOR A DRIVE TRAIN IN A MOTOR VEHICLE

(75) Inventors: Georg Feldhaus, Stuttgart (DE); Eberhard Pantow, Moeglingen (DE)

(73) Assignee: Behr GmbH & Co. KG, Stuttgart (DE)

( * ) Notice: Subject to any disclaimer, the term of this patent is extended or adjusted under 35 U.S.C. 154(b) by 832 days.

(21) Appl. No.: 12/525,594

(22) PCT Filed: Jan. 31, 2008

(86) PCT No.: PCT/EP2008/000751

§ 371 (c)(1), (2), (4) Date: Mar. 8, 2010

(87) PCT Pub. No.: WO2008/095638

PCT Pub. Date: Aug. 14, 2008

(65) Prior Publication Data

US 2010/0170455 A1 Jul. 8, 2010

(30) Foreign Application Priority Data

Feb. 3, 2007 (DE) ..... 10 2007 005 391

(51) Int. Cl.

| | |
|---|---|
| ***F02F 1/14*** | (2006.01) |
| ***F01P 1/06*** | (2006.01) |
| ***F01P 5/10*** | (2006.01) |
| ***F01P 3/20*** | (2006.01) |
| ***F01P 7/00*** | (2006.01) |
| ***F01P 7/02*** | (2006.01) |

(52) U.S. Cl.

USPC ..... 123/41.8; 123/41.31; 123/41.44; 123/41.51; 123/41.02; 123/41.05; 123/41.13

(58) Field of Classification Search

USPC ..... 123/41.31, 41.44, 41.51, 41.02, 41.05, 123/41.13

See application file for complete search history.

(56) References Cited

U.S. PATENT DOCUMENTS

| | | | | |
|---|---|---|---|---|
| 4,061,187 | A * | 12/1977 | Rajasekaran et al. | 165/104.31 |
| 4,325,219 | A * | 4/1982 | Stang et al. | 60/599 |
| 4,369,738 | A * | 1/1983 | Hirayama | 123/41.1 |
| 4,370,950 | A * | 2/1983 | Furukubo | 123/41.08 |
| 4,381,736 | A * | 5/1983 | Hirayama | 123/41.1 |

(Continued)

FOREIGN PATENT DOCUMENTS

| | | | |
|---|---|---|---|
| DE | 4104093 | A1 | 8/1992 |
| DE | 10317003 | A1 | 12/2004 |

(Continued)

OTHER PUBLICATIONS

Foreign Auto & Supply, Inc., ATF Heat Sink, Oct. 12, 2002, Foreign Auto & Supply, Inc., www.foreignautosupply.com/parts-accessories/1-automatic-transmission-heat-sink/.*

(Continued)

*Primary Examiner* — Lindsay Low
*Assistant Examiner* — Charles Brauch
(74) *Attorney, Agent, or Firm* — Bachman & LaPointe, P.C.

(57) ABSTRACT

The invention relates to a cooler arrangement for a drive train (21) in a motor vehicle (23). Said cooler arrangement comprises a first coolant circuit (3) with a first coolant cooler (7) as well as a second coolant circuit (5) with a second coolant cooler (9). The invention is characterized in that there is a connection between the first coolant circuit (3) and the second coolant circuit (5).

14 Claims, 1 Drawing Sheet

(56) References Cited

U.S. PATENT DOCUMENTS

| | | | | | |
|---|---|---|---|---|---|
| 4,385,594 | A | * | 5/1983 | Hauser, Jr. | 123/41.29 |
| 4,413,596 | A | * | 11/1983 | Hirayama | 123/41.1 |
| 5,215,044 | A | | 6/1993 | Banzhaf et al. | |
| 5,537,956 | A | * | 7/1996 | Rennfeld et al. | 123/41.29 |
| 5,678,760 | A | * | 10/1997 | Muso et al. | 237/2 A |
| 6,394,210 | B2 | * | 5/2002 | Matsuda et al. | 180/68.1 |
| 6,450,275 | B1 | * | 9/2002 | Gabriel et al. | 180/65.23 |
| 6,467,286 | B2 | * | 10/2002 | Hasebe et al. | 62/185 |
| 6,616,059 | B2 | | 9/2003 | Sabhapathy et al. | |
| 6,931,850 | B2 | * | 8/2005 | Frank et al. | 60/608 |
| 6,969,550 | B2 | * | 11/2005 | Sato et al. | 428/219 |
| 7,047,913 | B2 | | 5/2006 | Werner et al. | |
| 2006/0117748 | A1 | | 6/2006 | Bundschuh et al. | |
| 2006/0225417 | A1 | | 10/2006 | Pantow et al. | |
| 2007/0186912 | A1 | | 8/2007 | Holzbaur et al. | |

FOREIGN PATENT DOCUMENTS

| | | | | |
|---|---|---|---|---|
| DE | 10319762 | A1 | | 12/2004 |
| DE | 102004060658 | A1 | | 8/2005 |
| DE | 102004021551 | A1 | | 2/2006 |
| EP | 1564389 | A1 | | 8/2005 |
| GB | 2383840 | A | | 7/2003 |
| JP | 10252464 | A | | 9/1998 |
| JP | 11022460 | A | | 1/1999 |
| JP | 11022466 | A | | 1/1999 |
| JP | 2004332744 | A | * | 11/2004 |
| WO | 2004090303 | A1 | | 10/2004 |

OTHER PUBLICATIONS

German Search Report for DE 10 2007 005 391.8.

* cited by examiner

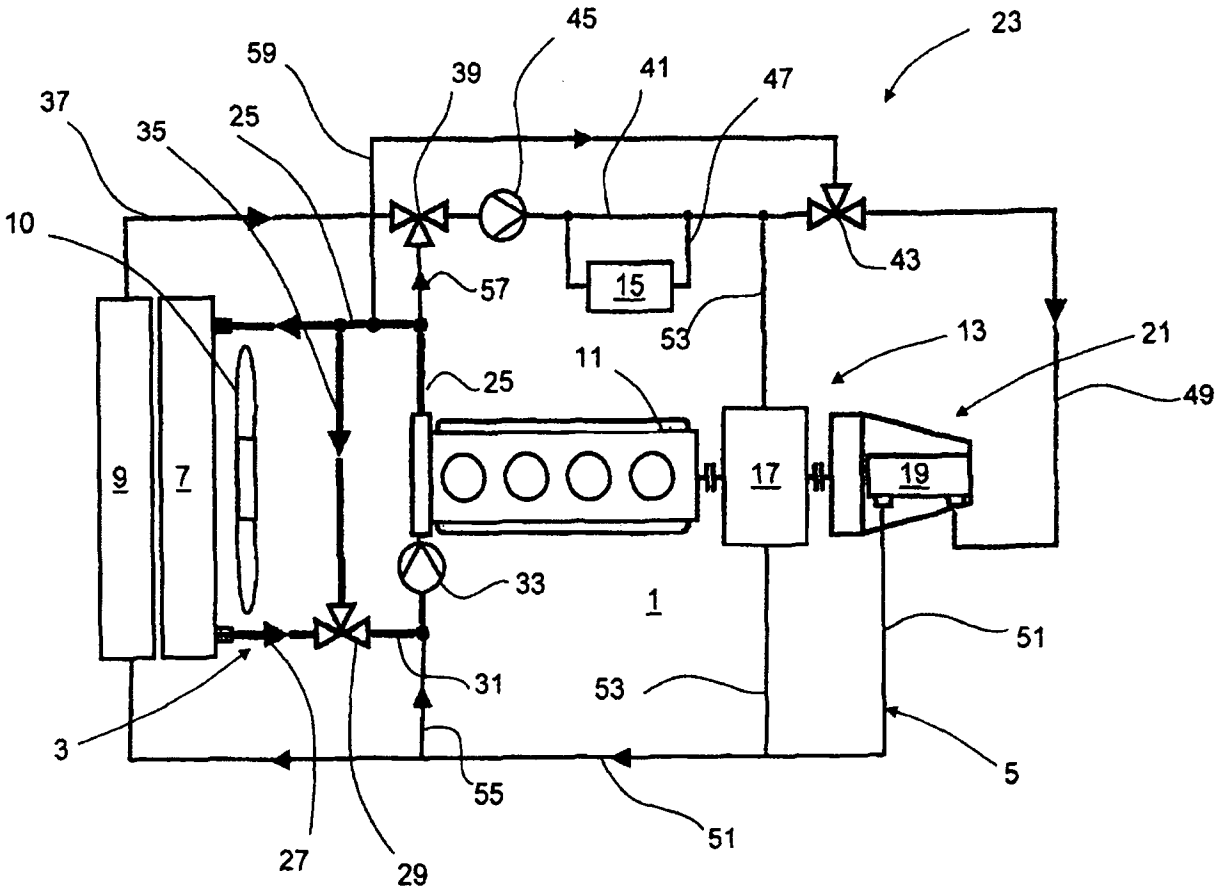
23
49
21
13
19
17
15
43
47
41
45
39
59
25
35
37
10
9
7
57
53
11
1
25
33
31
29
27
3
51
5
55

COOLER ARRANGEMENT FOR A DRIVE TRAIN IN A MOTOR VEHICLE

BACKGROUND OF THE INVENTION

The invention relates to a cooler arrangement for a drivetrain of a motor vehicle, having a first coolant circuit with a first coolant cooler, and having a second coolant circuit with a second coolant cooler.

Cooler arrangements for a drivetrain of a motor vehicle are known. Such cooler arrangements are used in particular for motor vehicles with various units whose operating temperatures differ. In hybrid vehicles, it is for example possible for the internal combustion engine and the electric motor to be assigned in each case to one of the coolant circuits.

It is an object of the invention to optimize the cooling of the drivetrain of a motor vehicle.

SUMMARY OF THE INVENTION

The object is achieved in a cooler arrangement for a drivetrain of a motor vehicle, having a first coolant circuit with a first coolant cooler, and having a second coolant circuit with a second coolant cooler, in that a connection is provided between the first coolant circuit and the second coolant circuit. It is advantageously possible for heat to be exchanged between the coolant circuits via the connection. This may advantageously take place as a function of the operating state of the associated motor vehicle. In a hybrid vehicle, for example, a conventional internal combustion engine and an electric motor are combined in order to provide the propulsion of the motor vehicle. In order to maintain the admissible operating temperatures, it is necessary for heat to be dissipated from both the engine and the motor and from the associated auxiliary units such as, inter alia, a transmission, power electronics and a battery. Under some circumstances, the internal combustion engine and the electric components operate at different temperature levels which may be regulated by means of the first coolant circuit and the second coolant circuit. The first coolant circuit and the second coolant circuit may be operated substantially separately from one another and consequently provide the different temperature levels. It is advantageously possible, however, for heat to be exchanged between the first and second coolant circuits via the connection in order to provide heat for components such that said components attain favorable operating temperatures more quickly, that is to say operate with optimum efficiency more quickly, and consequently contribute to a fuel saving in the motor vehicle. In particular, for thermal management during the start-up of a cold motor vehicle when the units are cold, the connection may advantageously be used to enable an exchange across the circuit boundaries of the first coolant circuit and of the second coolant circuit. This may take place in particular directly after the commencement of driving, that is to say when the engine and motor and the circuits are cold. It is advantageously possible, for example, for the waste heat from one of the two coolant circuits, which reaches a relatively high temperature level more quickly, to be supplied to the respective other coolant circuit via the connection. It is thus possible for said waste heat not to be dissipated to the environment but rather to be transferred to the respective other coolant circuit via the connection.

This may advantageously take place if the internal combustion engine is first set in operation at a relatively late time, that is to say if the cold motor vehicle initially starts with drive provided by the electric motor. In this case, the internal combustion engine may be pre-heated by means of the waste heat of the electric motor and of the associated auxiliary units, as a result of which the friction losses are reduced and better emissions values are also obtained. In a further operating state of the internal combustion engine, it is also conceivable to heat the transmission of the drivetrain, which transmission likewise generates relatively high friction losses, which reduce the efficiency of the drivetrain, in the cold state. The transmission is conventionally assigned to the relatively cool coolant circuit, and thus acts as a heat source in said circuit. By means of the connection, however, it is possible for the relatively high temperature level of the coolant circuit assigned to the internal combustion engine to be utilized for pre-heating the transmission. This is conceivable in particular if the motor vehicle is initially and/or predominantly operated using the internal combustion engine, that is to say if said internal combustion engine reaches its optimum operating temperature more quickly than the transmission, such that a transfer of heat via the connection to the transmission is expediently possible.

One preferred exemplary embodiment of the cooler arrangement is characterized in that the cooler arrangement has a valve arrangement which controls the connection. The two coolant circuits may be coupled to one another by means of the connection and the valve arrangement so as to enable an exchange of coolant and therefore of heat. The valve arrangement can control the correspondingly required coolant flows for this purpose, that is to say shut off or enable or control and/or throttle said flows. It is therefore possible, when the internal combustion engine is cold and at a standstill, for coolant to be conducted from the coolant circuit with the relatively low temperature level, for example from the second coolant circuit, through the cold internal combustion engine which therefore acts as a heat sink. The engine is heated without running, such that when the internal combustion engine is actually started, the friction and therefore fuel consumption have already been reduced. The heat generated in the second coolant circuit is thus retained within the overall cooling system and is not dissipated to the environment. When the coolant temperature at the outlet of the internal combustion engine is higher than the temperature upstream of a transmission oil cooler of the second coolant circuit, the valve arrangement may advantageously be switched such that heated coolant from the internal combustion engine can be supplied via the connection to the transmission oil cooler of the second coolant circuit. The friction in the transmission can thereby advantageously be reduced more quickly.

A further preferred exemplary embodiment of the cooler arrangement is characterized in that the first coolant circuit is assigned to an internal combustion engine of the drivetrain, and the second coolant circuit is assigned to a unit arrangement, which interacts with the internal combustion engine, of the drivetrain. It is thus possible for the internal combustion engine to be operated at a different temperature level from the rest of the unit arrangement.

A further preferred exemplary embodiment of the cooler arrangement is characterized in that the unit arrangement has an electric motor which interacts with the internal combustion engine, power electronics which control the electric motor, and/or a transmission which interacts with the electric motor and/or with the internal combustion engine. The cooler arrangement may thus be used advantageously for a wide variety of embodiments of hybrid drives, in particular series hybrids, parallel hybrids and/or mixed hybrids. It is possible in particular for the internal combustion engine to be operated at a relatively high temperature level by means of the first coolant circuit and for the rest of the hybrid components to be operated at a comparatively low temperature level by means of the second coolant circuit.

A further preferred exemplary embodiment of the cooler arrangement is characterized in that the connection has a first connecting line which is connected between the first and second coolant circuits downstream of the unit arrangement and upstream of the internal combustion engine. It is thus possible, via the first connecting line, for coolant of the second coolant circuit to be supplied, proceeding from the unit arrangement, to the internal combustion engine via a partial section of the first coolant circuit.

A further preferred exemplary embodiment of the cooler arrangement is characterized in that the first coolant circuit has a first regulating valve, with the first regulating valve being arranged upstream of the internal combustion engine and upstream of the first connecting line. It can consequently be ensured, with the first regulating valve closed, that both a bypass circuit of the first coolant circuit and also the first coolant cooler can be supplied with coolant fluid. Said switching position of the first regulating valve is thus expedient if, with the second regulating valve open, the internal combustion engine serves as a heat sink.

A further preferred exemplary embodiment of the cooler arrangement is characterized in that the connection has a second connecting line which is connected between the first and second coolant circuits downstream of the internal combustion engine and upstream of the unit arrangement. It is thus possible, via the second connecting line, for coolant to be supplied, proceeding from the internal combustion engine, to the unit arrangement via a partial section of the second coolant circuit.

A further preferred exemplary embodiment of the cooler arrangement is characterized in that the valve arrangement has a second regulating valve which controls the second connecting line. The second connecting line can be blocked, opened or partially opened by means of the second regulating valve. It is consequently possible by means of the second regulating valve to control or regulate the exchange of heat or the exchange of coolant between the coolant circuits. This may advantageously take place as a function of the operating state of the motor vehicle, in particular as a function of the respective temperature level in the internal combustion engine and in the unit assembly. Closing the regulating valve consequently brings the coolant flow in the second connecting line to a standstill. Since the first and second coolant circuits are in each case closed systems, it is also possible by closing the second regulating valve to substantially prevent an overflow of coolant via the first connecting line, which preferably does not have a regulating valve.

A further preferred exemplary embodiment of the cooler arrangement is characterized in that the connection has a third connecting line which is connected between the first and second coolant circuits downstream of the internal combustion engine, downstream of the power electronics and upstream of the transmission. It is thus advantageously possible, via the third connecting line, for in particular hot coolant to be supplied, proceeding from the internal combustion engine, to the transmission oil cooler via a partial section of the second coolant circuit. It is advantageous that the power electronics can be bypassed by means of the third connecting line. It is thereby possible to prevent the power electronics from being heated above their admissible operating temperature for example in the event of hot coolant being transported proceeding from the internal combustion engine.

A further preferred exemplary embodiment of the cooler arrangement is characterized in that the valve arrangement has a third regulating valve which controls the third connecting line. The third regulating valve can, similarly to the second regulating valve, control or regulate the exchange of coolant via the third connecting line. The second regulating valve is preferably closed if the third regulating valve is to be opened. The second regulating valve is preferably connected into the second coolant circuit upstream of the power electronics. It is consequently possible for a shut-off of the second regulating valve, with a simultaneous opening of the third regulating valve, to connect the third connecting line as a bypass for the power electronics, such that the latter cannot under any circumstances be acted on with the hot coolant of the internal combustion engine.

The object is also achieved, in a method for operating a motor vehicle having a cooler arrangement, in particular having a cooler arrangement as described in more detail above, by the following step: transferring heat between the first coolant circuit and the second coolant circuit. It is thus possible for the two coolant circuits to be connected as a heat sink or heat source for the respective other coolant circuit depending on the operating state.

One preferred exemplary embodiment of the method is characterized by the following step: transferring the heat from the unit arrangement as a heat source to the internal combustion engine as a heat sink. This may advantageously take place during the warm running of the vehicle when the vehicle is operated predominantly using the electric motor. Here, the temperature in the second coolant circuit rises more quickly than in the first coolant circuit, thereby enabling a transfer of heat from the second coolant circuit into the first coolant circuit.

A further preferred exemplary embodiment of the method is characterized by the following step: feeding heated coolant from the second coolant circuit into the first coolant circuit via the first connecting line and feeding cooled coolant from the first coolant circuit into the second coolant circuit via the second connecting line. It is thus possible for a further coolant circuit, which may be superposed on the first and second coolant circuits, to run via the first and second connecting lines. It is advantageously possible in this way for the internal combustion engine to be warmed up using the waste heat of the unit arrangement.

A further preferred exemplary embodiment of the method is characterized by the following step: blocking the third connecting line by means of the third regulating valve and opening up the second connecting line by means of the second regulating valve. It is thus possible by means of the regulating valves to control or regulate the desired exchange of coolant.

A further preferred exemplary embodiment of the method is characterized by the following step: transferring heat from the internal combustion engine as a heat source to the transmission of the unit arrangement as a heat sink. By means of this step, it is thus possible to heat the transmission up to its operating temperature as quickly as possible by means of the warm internal combustion engine.

A further preferred exemplary embodiment of the method is characterized by the following step: feeding heated coolant from the first coolant circuit into the second coolant circuit via the third connecting line and feeding cooled coolant from the second coolant circuit into the first coolant circuit via the first connecting line. It is thus possible for a further coolant circuit, which may be superposed on the first and second coolant circuits, to be formed via the first and third connecting lines.

A further preferred exemplary embodiment of the method is characterized by the following step: blocking the second connecting line by means of the second regulating valve and opening up the third connecting line by means of the third regulating valve. It is thus possible by means of the second and third regulating valves to control or regulate the corresponding exchange of coolant between the first and second coolant circuits.

The object is also achieved in a motor vehicle, in particular with hybrid drive, by means of a cooler arrangement designed as described above.

BRIEF DESCRIPTION OF THE DRAWINGS

Further advantages, features and details of the invention can be gathered from the following description, in which an exemplary embodiment is described in detail with reference to the drawing.

The single FIG. 1 shows a schematic diagram of a cooler arrangement having a first coolant circuit and a second coolant circuit.

DETAILED DESCRIPTION

FIG. 1 shows a cooler arrangement 1 having a first coolant circuit 3 and a second coolant circuit 5. The first coolant circuit 3 has a first coolant cooler 7. The second coolant circuit 5 has a second coolant cooler 9. For the aeration of the coolant coolers 7 and 9, the cooler arrangement 1 may have a fan 10, for example a fan which is preferably controlled in a temperature-dependent fashion and which is driven electrically and/or coupled, in particular in a temperature-dependent fashion, to an internal combustion engine 11.

The first coolant circuit 3 is assigned to the internal combustion engine 11. The second coolant circuit 5 is assigned to a unit arrangement 13. The unit arrangement 13 has power electronics 15, an electric motor 17 and a transmission 19 which, together with the internal combustion engine 11, may be parts of a drivetrain 21 of a motor vehicle 23. The motor vehicle 23 may be a vehicle with hybrid drive, with the internal combustion engine 11 together with the electric motor 17 serving as the drive source of the motor vehicle 23. For this purpose, the transmission 19 may be assigned further drive units (not illustrated in FIG. 1) of the motor vehicle 23.

The internal combustion engine 11 can be cooled, or kept at operating temperature, by means of the first coolant circuit 3. For this purpose, the internal combustion engine 11 is connected, downstream, to the first coolant cooler 7 via a first cooling line 25. The first coolant cooler 7 is connected, downstream, to a first regulating valve 29 via a second coolant line 27. The first regulating valve 29 is connected, downstream, to a first coolant pump 33 of the first coolant circuit 3 via a third coolant line 31. The first coolant pump 33 is arranged downstream of the internal combustion engine 11 of the motor vehicle 23.

A bypass line 35 is connected between the first coolant line 25 and the first regulating valve 29. The coolant lines 25, 27 and 31, the bypass line 35, the first coolant pump 33 and the first regulating valve 29 form a high-temperature coolant circuit with a small bypass circuit for the internal combustion engine 11. The first coolant circuit 3 can be operated independently of the second coolant circuit 5 during a start-up of the internal combustion engine, as follows. When the internal combustion engine 11 is cold, the first coolant pump 33 can be deactivated, such that no circulation of coolant takes place. In particular in the event of the first coolant pump being mechanically coupled to the internal combustion engine, it may also be provided that the pump operates against a closed circuit, as a result of which no coolant is circulated with the possible exception of a small leakage flow. When first parts of the internal combustion engine 11 reach the maximum admissible operating temperature, the first coolant pump 33 can circulate the coolant of the first coolant circuit 3. For this purpose, the first regulating valve 29 may initially be switched so as to enable a flow of fluid from the bypass line 35 into the third coolant line 31 and block a flow of fluid from the second coolant line 27 into the third coolant line 31. The internal combustion engine 11 is thus operated by means of a bypass circuit or small coolant circuit via the bypass line 35, with the omission of the first coolant cooler 7. When the coolant temperature in the small cooling circuit exceeds a maximum admissible value, the first regulating valve 29 can provide a dosed flow of cold coolant from the second coolant line 27 into the third coolant line 31. Here, the coolant flow in the bypass line 35 may at the same time be correspondingly throttled by means of the first regulating valve 29.

The second coolant cooler 9 is connected, downstream, to a second regulating valve 39 via a fourth coolant line 37. The second regulating valve 39 is connected, downstream, to a third regulating valve via a fifth coolant line 41. Connected into the fifth coolant line 41 is a second coolant pump 45 for circulating the coolant in the second coolant circuit 5. Downstream of the second coolant pump 45, the power electronics 15 are connected in parallel with the fifth coolant line 41 by means of a parallel coolant line 47. It is thus possible by means of the parallel coolant line 47 for a part of the coolant fed by the second coolant pump 45 to be conducted past the power electronics 15 in order to cool the latter. The third regulating valve 43 is connected, downstream, to the transmission 19 of the drivetrain 21 of the motor vehicle 23 by means of a sixth coolant line 49. The transmission 19, or a corresponding transmission oil cooler of the transmission 19, is connected, downstream, to the second coolant cooler 9 by means of a seventh coolant line 51. The electric motor 17 is connected by means of an electric motor coolant line 53 to the fifth coolant line 41 and to the seventh coolant line 51. Here, the electric motor coolant line 53 branches off to the electric motor 17 downstream of the power electronics 15 and upstream of the third regulating valve 43, and opens out into the seventh coolant line 51 of the second coolant circuit 5 downstream of the transmission 19. Consequently, the electric motor 17 and the transmission 19 are connected fluidically in parallel in the second coolant circuit 5, with it being possible for the third regulating valve 43 to control the ratio of the flow rates by correspondingly shutting off or throttling the sixth coolant line 49.

A first connecting line 55 branches off downstream of the electric motor 17 and the transmission 19, which first connecting line 55 opens out, downstream, into the third coolant line 31 of the first coolant circuit 3. The first coolant circuit 3 and second coolant circuit 5 are thus fluidically connected to one another by means of the first connecting line 55. The second regulating valve 39 of the second coolant circuit 5 is connected, upstream, to the first coolant line 25 of the first coolant circuit 3 by means of a second connecting line 57. Furthermore, the third regulating valve 43 is likewise connected, upstream, to the first coolant line 25 of the first coolant circuit 3 by means of a third connecting line 59.

Below, a description is given of different thermal management strategies with reference to FIG. 1, wherein in each case, heat is transferred between the first coolant circuit 3 and the second coolant circuit 5.

In a first operating state of the vehicle 23, in particular after a start when the units are cold, the motor vehicle may be driven predominantly by means of the electric motor 17. In this operating state, the unit arrangement 13, that is to say the power electronics 15, the electric motor 17 and the transmission 19, acts as a heat source. The heat generated by the unit arrangement 13 is transmitted to the coolant of the second coolant circuit 5. In this operating state, the internal combustion engine 11 is not in operation, and is consequently relatively cool. It is however desirable for the internal combustion engine 11 to be pre-heated as far as possible before being started up, in order to reduce undesired emissions and high friction values to a minimum. To achieve this, the second regulating valve 39 may be switched such that the second connecting line 57 is connected via the second regulating valve 39 and the fifth coolant line 41 to the second coolant pump 45 of the second coolant circuit 5. Furthermore, the second regulating valve 39 may be switched such that the fourth coolant line 37 is not connected to the fifth coolant line 41 of the second coolant circuit 5. Consequently, the coolant situated in the second coolant cooler 9 of the second coolant circuit 5 is at a standstill, that is to say said coolant is not circulated.

Driven by the second coolant pump 45 and the first coolant pump 33, if the internal combustion engine is running, a circuit is thus generated proceeding from the second coolant pump 45 via the fifth coolant line 41, via the parallel coolant line 47 which is connected parallel thereto and the power electronics 15 connected to said parallel coolant line 47, via the electric motor coolant line 53 and the electric motor 17 which is connected thereto, via the seventh coolant line 51, via the first connecting line 55, via the third coolant line 31 and the first coolant pump 33 which is connected thereto and the internal combustion engine 11 which is connected to said first coolant pump 33, via the first coolant line 25 of the first coolant circuit 3 and finally via the second connecting line 57, via the second regulating valve 39 and via the fifth coolant line 41 back to the second coolant pump 45 of the second coolant circuit 5. Furthermore, depending on the opening position of the third regulating valve 43, a branched flow parallel to the electric motor coolant line 53 takes place from the third regulating valve 43 via the sixth coolant line 49, via the transmission 19 and finally via the seventh coolant line 51 into the first connecting line 55.

It is thus possible for coolant which is heated by the unit arrangement 13 to be supplied from the first coolant circuit 3 via the first connecting line 55 to the internal combustion engine 11 which, in this operating state, serves as a heat sink. It can be seen that, by correspondingly regulating the second regulating valve 39, all of the waste heat of the unit arrangement 13 can be kept within the drivetrain 21 of the motor vehicle 23. In this operating state, therefore, neither the first coolant cooler 7 nor the second coolant cooler 9 is traversed by flow, thereby effectively preventing any heat from being dissipated to the environment.

In a further operating state of the motor vehicle 23, the coolant temperature of the coolant in the first coolant line 25 may exceed the coolant temperature downstream of the transmission 19 in the seventh coolant line 51. In this operating state, therefore, it may be desirable to heat the transmission by means of the waste heat of the internal combustion engine 11, that is to say to use the internal combustion engine 11 as a heat source and the transmission 19 as a heat sink. This operating state may occur for example when the internal combustion engine 11 has already reached its full operating temperature, that is to say for example when the first regulating valve 29 has already been switched such that the coolant flow of the first coolant circuit 3 is conducted at least partially via the first coolant cooler 7.

Here, it is possible for a part of the coolant flow or for the entire coolant flow emerging from the internal combustion engine 11 to be branched out of the first coolant line 25 into the third connecting line 59, that is to say to supply said coolant flow to the third regulating valve 43.

In this operating state, the third regulating valve 43 may be switched so as to connect the third connecting line 59 to the sixth coolant line 49 and to fully or partially block the fifth coolant line 41. The internal combustion engine 11 is thus connected, downstream, to the transmission 19 via the first coolant line 25, the third connecting line 59, the third regulating valve 43 and finally the sixth coolant line 49. The seventh coolant line 51 is in turn connected, downstream, to the internal combustion engine 11 via the first connecting line 55, the third coolant line 31 and the first coolant pump 33.

By means of this connection, it is thus possible for the coolant quantity extracted via the third connecting line 59 to be correspondingly returned from the second coolant circuit 5 back to the first coolant circuit 3.

A third coolant circuit is thereby generated which is partially superposed on the first coolant circuit 3. Furthermore, in this operating state, depending on the switching position of the third regulating valve 43, the described third coolant circuit is separated from the second coolant circuit 5 or is superposed on the latter only in the seventh coolant line 51 downstream of the point at which the electric motor coolant line 53 opens in.

This is necessary because cooling of the power electronics 15 is required at all times. For this purpose, coolant is circulated within the second coolant circuit 5 by the second coolant pump 45, with the transmission 19 however being disconnected from said circulation by means of the third regulating valve 43. To enable said circulation, the second regulating valve 39 is switched such that the second connecting line 57 is blocked and the fourth coolant line 37 is entirely or partially connected to the fifth coolant line 41 according to the required coolant quantity. A coolant flow which corresponds precisely to the coolant quantity extracted from the first coolant circuit 3 is thus generated downstream of the third regulating valve 43 and upstream of the branch of the first connecting line 55 from the seventh coolant line 51. It is however also conceivable for the third regulating valve to be at least partially opened between the fifth coolant line 41 and the sixth coolant line 49, with an increased coolant flow, which is increased by precisely the coolant quantity extracted from the first coolant circuit 3, being generated in the described section of the second coolant circuit 5.

It can be seen that, in this operating state, cooling of the power electronics 15 is ensured at all times and, as a result of the fact that the third connecting line 59 opens in downstream of the power electronics 15 and upstream of the transmission 19, it is nevertheless ensured that the transmission 19 can be used as a heat sink for the internal combustion engine 11, that is to say the transmission 19 can be brought up to its operating temperature as quickly as possible. In addition to the transmission 19 as a heat sink, the first coolant cooler 7 of the first coolant circuit 3 also functions as a heat sink for the internal combustion engine 11 in said switching position of the valves 29, 39 and 43, such that overheating of the internal combustion engine 11 is prevented.

As a result of the described thermal management, it is possible to ensure an optimized warm running strategy for the internal combustion engine 11 and for the unit arrangement 13. For this purpose, the regulating valves 29, 39 and 43 must monitor the corresponding temperature profiles of the internal combustion engine 11 and of the unit arrangement 13 and assume corresponding closed and/or open positions. For the activation of the valves 29, 39 and 43, it is also possible to use a central regulating unit which is coupled to corresponding temperature sensors and/or further sensors and which is designed for regulating the temperature of the internal combustion engine 11 and of the unit arrangement 13 which interacts with said internal combustion engine 11.

The invention claimed is:

1. A cooler arrangement for a drivetrain of a motor vehicle, having a first coolant circuit with a first coolant cooler, and having a second coolant circuit with a second coolant cooler, wherein the first coolant circuit is assigned to an internal combustion engine of the drivetrain, and the second coolant circuit is assigned to a unit arrangement which interacts with the internal combustion engine and comprises power electronics and a transmission, wherein a connection is provided between the first coolant circuit and the second coolant circuit, and wherein the connection comprises a first connecting line which is connected between the first and second coolant circuits downstream of the unit arrangement and upstream of the internal combustion engine;

a second connecting line which is connected between the first and second coolant circuits downstream of the internal combustion engine and upstream of the unit arrangement; and a third connecting line which is connected between the first and second coolant circuits downstream of the internal combustion engine, downstream of the power electronics and upstream of the transmission.

2. The cooler arrangement as claimed in claim 1, wherein the cooler arrangement has a valve arrangement which controls the connection.

3. The cooler arrangement as claimed in claim 1, wherein the unit arrangement has an electric motor which interacts with the internal combustion engine, the power electronics control the electric motor, and the transmission interacts with the electric motor and/or with the internal combustion engine.

4. The cooler arrangement as claimed in claim 1, wherein the first coolant circuit has a first regulating valve, with the first regulating valve being arranged upstream of the internal combustion engine and downstream of the first connecting line or downstream of the internal combustion engine and upstream of the first connecting line.

5. The cooler arrangement as claimed in claim 1, wherein the valve arrangement has a second regulating valve which controls the second connecting line.

6. The cooler arrangement as claimed in claim 1, wherein the valve arrangement has a third regulating valve which controls the third connecting line.

7. A method for operating a motor vehicle having a cooler arrangement, wherein a first coolant circuit with a first coolant cooler, and having a second coolant circuit with a second coolant cooler, wherein the first coolant circuit is assigned to an internal combustion engine of the drivetrain, and the second coolant circuit is assigned to a unit arrangement which interacts with the internal combustion engine and comprises power electronics and a transmission, wherein a connection is provided between the first coolant circuit and the second coolant circuit, and wherein the connection comprises a first connecting line which is connected between the first and second coolant circuits downstream of the unit arrangement and upstream of the internal combustion engine;

a second connecting line which is connected between the first and second coolant circuits downstream of the internal combustion engine and upstream of the unit arrangement; and a third connecting line which is connected between the first and second coolant circuits downstream of the internal combustion engine, downstream of the power electronics and upstream of the transmission, comprising the following step:

transferring heat between the first coolant circuit and the second coolant circuit.

8. The method as claimed in claim 7, further comprising the following step:

transferring the heat from the unit arrangement as a heat source to the internal combustion engine as a heat sink.

9. The method as claimed in claim 7, further comprising the following step:

feeding heated coolant from the second coolant circuit into the first coolant circuit via the first connecting line and feeding cooled coolant from the first coolant circuit into the second coolant circuit via the second connecting line.

10. The method as claimed in claim 9, further comprising the following step:

blocking the third connecting line by means of the third regulating valve and opening up the second connecting line by means of the second regulating valve.

11. The method as claimed in claim 10, further comprising the following step:

transferring heat from the internal combustion engine as a heat source to the transmission of the unit arrangement as a heat sink.

12. The method as claimed in claim 11, further comprising the following step:

feeding heated coolant from the first coolant circuit into the second coolant circuit via the third connecting line and feeding cooled coolant from the second coolant circuit into the first coolant circuit via the first connecting line.

13. The method as claimed in claim 12, further comprising the following step:

blocking the second connecting line by means of the second regulating valve and opening up the third connecting line by means of the third regulating valve.

14. A motor vehicle with hybrid drive, comprising a cooler arrangement, wherein a first coolant circuit with a first coolant cooler, and having a second coolant circuit with a second coolant cooler, wherein the first coolant circuit is assigned to an internal combustion engine of the drivetrain, and the second coolant circuit is assigned to a unit arrangement which interacts with the internal combustion engine and comprises power electronics and a transmission, wherein a connection is provided between the first coolant circuit and the second coolant circuit, and wherein the connection comprises a first connecting line which is connected between the first and second coolant circuits downstream of the unit arrangement and upstream of the internal combustion engine;

a second connecting line which is connected between the first and second coolant circuits downstream of the internal combustion engine and upstream of the unit arrangement; and a third connecting line which is connected between the first and second coolant circuits downstream of the internal combustion engine, downstream of the power electronics and upstream of the transmission.

* * * * *